US006085621A

United States Patent [19]

Nezigane

[11] Patent Number: 6,085,621

[45] Date of Patent: Jul. 11, 2000

[54] RATCHET WRENCH

[76] Inventor: Fumiyoshi Nezigane, 120-41, Minami-Numagami, Shizuoka-shi, Shizuoka-ken, Japan

[21] Appl. No.: 09/263,998

[22] Filed: Mar. 8, 1999

[30] Foreign Application Priority Data

Jun. 10, 1998 [JP] Japan ..... 10-004635

[51] Int. Cl.[7] ..... B25B 19/00

[52] U.S. Cl. ..... 81/465; 173/93

[58] Field of Search ..... 81/465, 463, 52.3, 81/52.35, 466, 63.2, 63.1; 173/93

[56] References Cited

U.S. PATENT DOCUMENTS

| | | | |
|---|---|---|---|
| 3,949,816 | 4/1976 | Harvath | 173/93 |
| 5,161,440 | 11/1992 | Jordan | 81/463 |
| 5,259,276 | 11/1993 | Baron | 81/58.2 |
| 5,860,337 | 1/1999 | Janssen | 81/63 |

FOREIGN PATENT DOCUMENTS 56-137969 of 1981 Japan .

*Primary Examiner*—James G. Smith
*Assistant Examiner*—Hadi Shakeri
*Attorney, Agent, or Firm*—Harrison & Egbert

[57] ABSTRACT

A ratchet wrench for turning bolts and nuts disposed in narrow or inaccessible places. The ratchet wrench is rotatably attached to an end of an operation rod. The ratchet wrench comprises a weight attached to the operation rod, the weight being slidable lengthwise along the operation rod, the operation rod being provided at a portion thereof in front of the weight with a front weight receiving portion against which the weight is struck. Alternatively, the operation rod may be provided at a portion thereof in the rear of the weight with a rear weight receiving portion against which the weight is struck. Also, the operation rod may be provided with both the front weight receiving portion and the rear weight receiving portion.

3 Claims, 3 Drawing Sheets

RATCHET WRENCH

BACKGROUND OF THE INVENTION (1) Field of the Invention

The present invention relates to a ratchet wrench. More particularly, the invention relates to a ratchet wrench for turning bolts and nuts disposed in narrow or inaccessible places in which conventional ratchet wrenches are not usable. For example, the ratchet wrench of the invention is used for turning bolts and nuts disposed within an engine compartment of an automotive vehicle.

(2) Description of the Prior Art

Japanese Utility Model Laid-Open Publication No. Sho 56-137969 (Japanese Utility Model Application No. Sho 55-34278) discloses a ratchet wrench rotatably attached to an end of an operation rod.

However, according to where bolts and nuts are disposed or how tight they are, it is often difficult to loosen the bolts and nuts by means of the above-mentioned conventional ratchet wrench rotatably attached to an end of an operation rod. Also, according to where the bolts and nuts are disposed, it is often difficult to tighten up the bolts and nuts by means of the above-mentioned conventional ratchet wrench.

SUMMARY OF THE INVENTION

It is therefore an object of the invention to provide a ratchet wrench which has obviated the above-mentioned disadvantages of the conventional ratchet wrench.

It is another object of the invention to provide a ratchet wrench which makes it possible to firmly tighten up bolts and nuts which are disposed in narrow or inaccessible places.

It is a further object of the invention to provide a ratchet wrench which makes it possible to loosen bolts and nuts which are disposed in narrow or inaccessible places and firmly tightened up.

These and other objects have been attained by a ratchet wrench rotatably attached to an end of an operation rod, the ratchet wrench comprising a weight attached to the operation rod, the weight being slidable lengthwise along the operation rod, the operation rod being provided at a portion thereof in front of the weight with a front weight receiving portion against which the weight is struck.

Alternatively, the operation rod may be provided at a portion thereof in the rear of the weight with a rear weight receiving portion against which the weight is struck.

Also, the operation rod may be provided with both the front weight receiving portion and the rear weight receiving portion.

In the specification and claims of the present invention, "front" means left in FIG. 1 and "rear" means right in FIG. 1.

The operation of the ratchet wrench according to the present invention will now be described.

The ratchet wrench in which the operation rod is provided with only the front weight receiving portion is used as follows:

A bolt or a nut is tightened up as follows: An engagement portion of the ratchet wrench is engaged with a bolt head or the nut with the ratchet wrench turned at a suitable angle in a proper direction with respect to the operation rod as shown by solid lines in FIG. 2. In this state, the weight is struck hard against the front weight receiving portion of the operation rod. Then, the operation rod is moved forward by the shock of the weight and strongly turns the ratchet wrench in a direction of tightening the bolt or the nut. The engagement portion of the ratchet wrench turns with the ratchet wrench by the action of a ratchet. Therefore, the bolt head or the nut is turned in a direction of being tightened. Now the ratchet wrench is turned back to the original angle by pulling the operation rod backward, and the bolt or the nut is tightened again by striking the weight hard against the front weight receiving portion of the operation rod. Needless to say, when the ratchet wrench is turned back to the original angle by pulling the operation rod backward, the ratchet prevents the engagement portion of the ratchet wrench from turning.

The bolt or the nut is loosened as follows: The ratchet wrench rotatably attached to an end of the operation rod is turned upside down and the same operation as mentioned above is made.

The ratchet wrench in which the operation rod is provided with only the rear weight receiving portion is used as follows:

The bolt or the nut is tightened as follows: The engagement portion of the ratchet wrench is engaged with the bolt head or the nut with the ratchet wrench turned at a suitable angle in a proper direction with respect to the operation rod as shown by chain lines in FIG. 2. In this state, the weight is struck hard against the rear weight receiving portion of the operation rod. Then, the bolt or the nut is tightened as mentioned above.

The bolt or the nut is loosened as follows: The ratchet wrench rotatably attached to the end of the operation rod is turned upside down and the same operation as mentioned above is made.

The ratchet wrench in which the operation rod is provided with both the front weight receiving portion and the rear weight receiving portion is used basically in the same way as mentioned above. The weight may be struck either against the front weight receiving portion of the operation rod or against the rear weight receiving portion of the operation rod according to the position of the bolt or the nut.

DETAILED DESCRIPTION OF THE INVENTION

Figure 1:
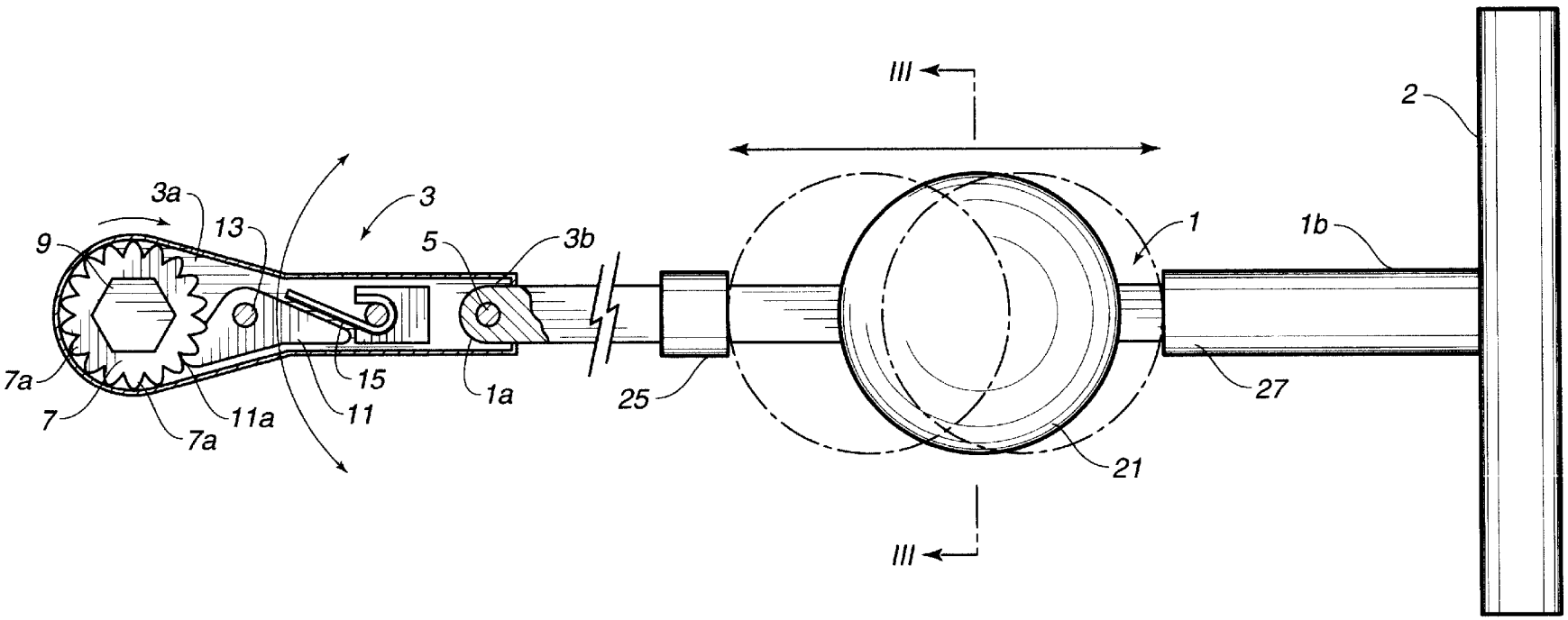
FIG. 1 is a partially sectional plan view showing a ratchet wrench according to the present invention.

The present invention will now be described in detail with reference to the attached drawings.

A ratchet wrench 3 is rotatably attached, by means of a shaft 5, to an end (front end) 1*a* of an operation rod 1. A rear end 3*b* of the ratchet wrench 3 is connected with the shaft 5 on which the ratchet wrench 3 turns. The operation rod 1 is provided at another end (rear end) 1*b* thereof with a handle 2.

The ratchet wrench 3 is provided at a front end 3*a* thereof with a ratchet (ratchet wheel) 7.

The ratchet wrench 3, which may be the same as a conventional ratchet wrench, will be briefly described. The ratchet 7 is rotatably attached to the front end 3*a* of the ratchet wrench 3 with a suitable bearing means (not shown).

Figure 2:
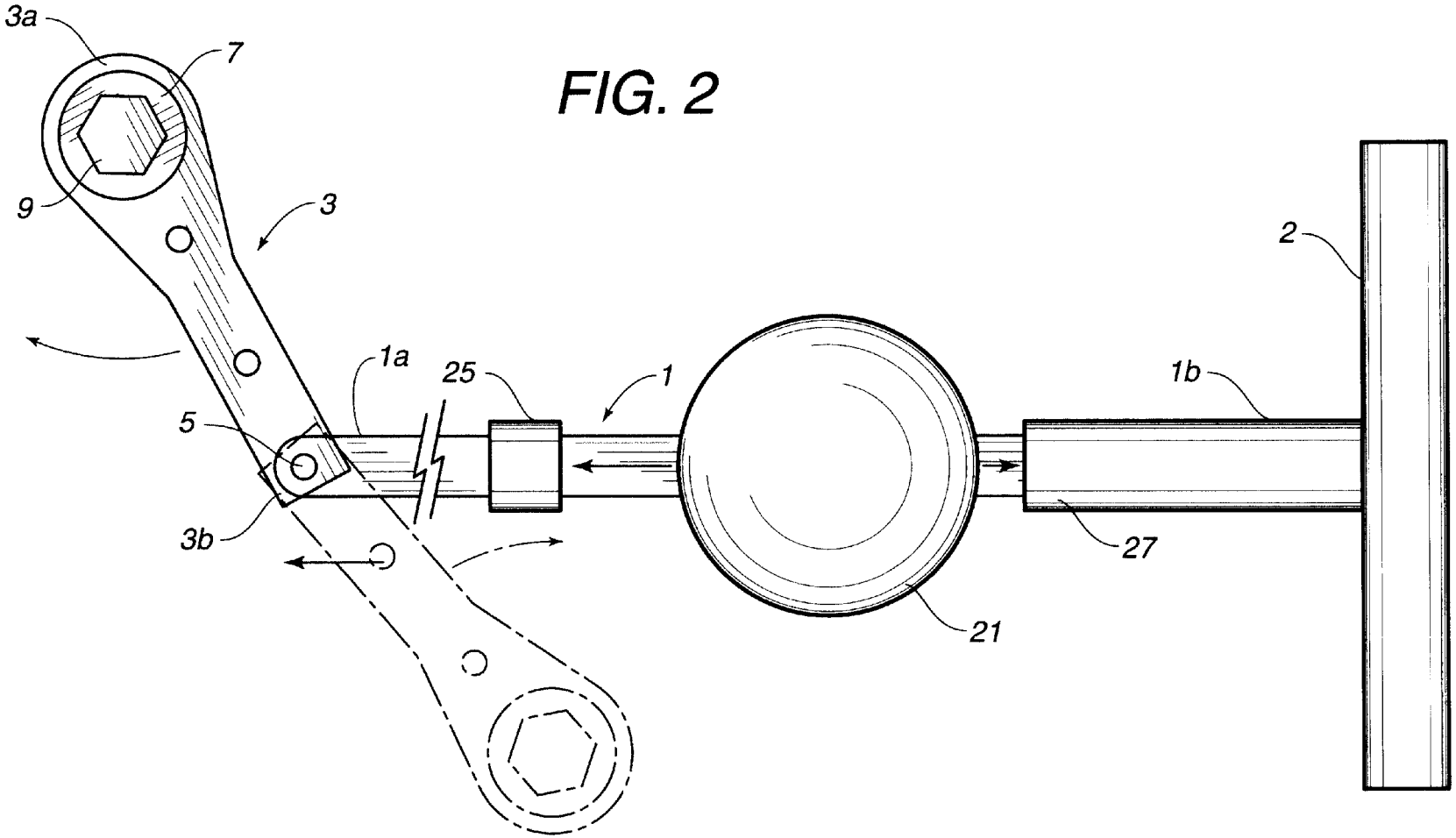
FIG. 2 is a plan view showing the operation of the ratchet wrench according to the present invention.

The ratchet 7 is provided in the center thereof with an engagement portion 9 which is engaged with a bolt head or a nut. The engagement portion 9 shown in Figs.1 and 2 is a hexagonal opening. A pawl 11 is pivotally attached near the ratchet 7 by means of a shaft 13. Teeth 7*a* of the ratchet 7 catch and hold an end or ends 11*a* of the pawl 11 so as to allow the ratchet 7 to rotate in only one direction. Reference symbol 15 represents a return spring for the pawl 11.

Figure 3:
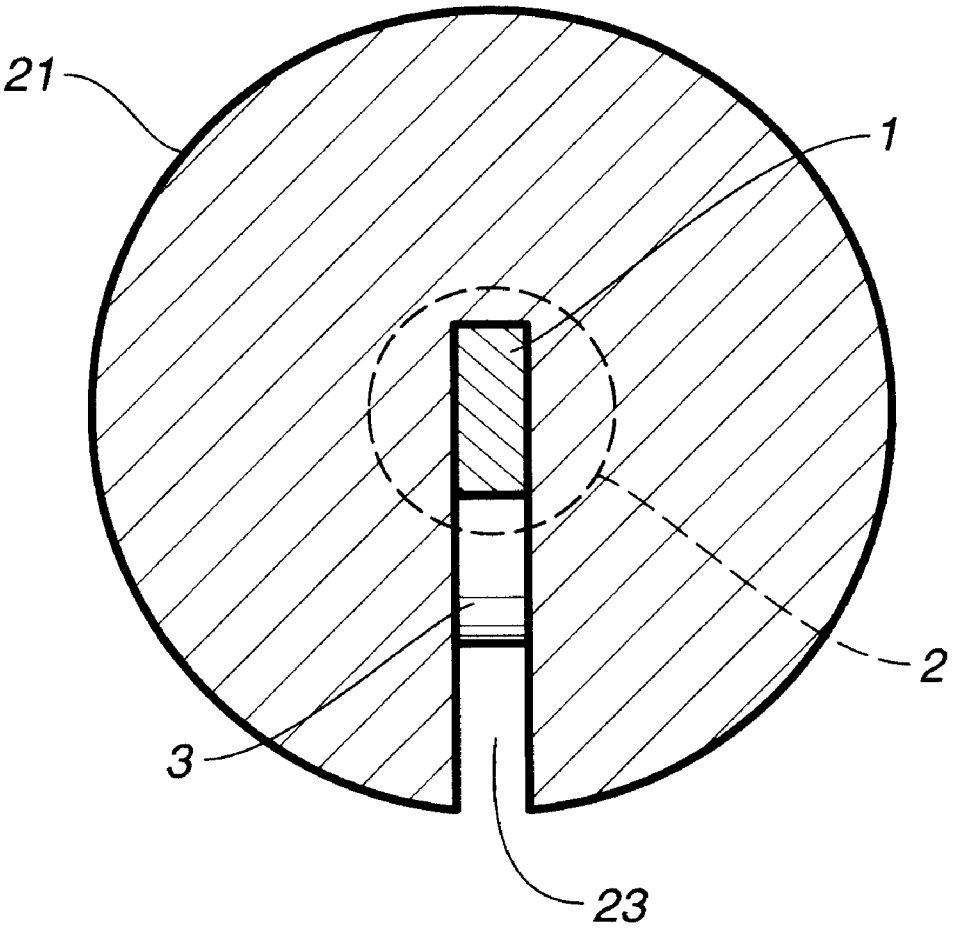
FIG. 3 is a sectional view taken along the line III—III of FIG. 1.

According to the present invention, a weight 21 is attached to the operation rod 1 so as to be slidable lengthwise along the operation rod 1. The weight 21 may be a casting for example. The weight 21 may have a spherical shape, a cylindrical shape, a prismatic shape or any other shape. The weight 21 shown in FIG. 3 has a cut 23 formed from an external surface of the weight 21 through the center of the weight 21. The operation rod 1 passes through the cut 23 of the weight 21 so that the weight 21 is detachable from the operation rod 1.

The operation rod 1 is provided at a portion thereof in front of the weight 21 with a front weight receiving portion 25 against which the weight 21 is struck.

Alternatively, the operation rod 1 may be provided at a portion thereof in the rear of the weight 21 with a rear weight receiving portion 27 against which the weight 21 is struck.

Also, the operation rod 1 may be provided with both the front weight receiving portion 25 and the rear weight receiving portion 27.

The present invention has the following advantages:

The ratchet wrench according to the present invention makes it possible to firmly tighten up bolts and nuts which are disposed in narrow or inaccessible places. Also, the ratchet wrench makes it possible to loosen bolts and nuts which are disposed in narrow or inaccessible places and firmly tightened up.

As many apparently widely different embodiments of the present invention may be made without departing from the spirit and scope thereof, it is to be understood that the invention is not limited to the specific embodiments thereof except as defined in the appended claims.

What is claimed is:

1. An apparatus for turning nuts and bolts comprising:

an operation rod;

a ratchet wrench rotatably attached to an end of said operation rod; and a weight attached to said operation rod, said weight being slidable lengthwise along said operation rod towards said ratchet wrench, said operation rod being provided at a portion thereof in front of said weight with a front weight receiving portion against which said weight is struck.

2. An apparatus for turning nuts and bolts comprising:

an operation rod;

a ratchet wrench rotatably attached to an end of said operation rod; and a weight attached to said operation rod, said weight being slidable lengthwise along said operation rod towards said ratchet wrench, said operation rod being provided at a portion thereof in a rear of said weight with a rear weight receiving portion against which said weight is struck.

3. An apparatus for turning nuts and blots comprising:

an operation rod;

a ratchet wrench rotatably attached to an end of said operation rod; and a weight attached to said operation rod, said weight being slidable lengthwise along said operation rod towards said ratchet wrench, said operation rod being provided at a portion thereof in front of said weight with a front weight receiving portion against which said weight is struck, said operation rod being further provided at another portion thereof in a rear of said weight with a rear weight receiving portion against which said weight is struck.

* * * * *